US011585210B2

(12) United States Patent
Al-Qasim et al.

(10) Patent No.: US 11,585,210 B2
(45) Date of Patent: Feb. 21, 2023

(54) ADVANCED MATERIALS GUN AND LOGGING BOTS FOR DEEP SATURATION MEASUREMENT

(71) Applicant: SAUDI ARABIAN OIL COMPANY, Dhahran (SA)

(72) Inventors: Abdulaziz S. Al-Qasim, Dammam (SA); Mutaz H. Alsubhi, Al-Khubar (SA); Khalid I. Alhamed, Ad Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 237 days.

(21) Appl. No.: 17/029,689

(22) Filed: Sep. 23, 2020

(65) Prior Publication Data

US 2022/0090491 A1 Mar. 24, 2022

(51) Int. Cl.

| | |
|---|---|
| ***E21B 47/11*** | (2012.01) |
| ***E21B 47/113*** | (2012.01) |
| ***E21B 49/00*** | (2006.01) |

(52) U.S. Cl.

CPC ..... *E21B 47/11* (2020.05); *E21B 47/114* (2020.05); *E21B 49/00* (2013.01)

(58) Field of Classification Search

CPC ..... E21B 47/11; E21B 47/114; E21B 49/00; E21B 49/08

See application file for complete search history.

(56) References Cited

U.S. PATENT DOCUMENTS

| | | | |
|---|---|---|---|
| 2,965,753 | A | 12/1960 | Reynolds et al. |
| 4,482,806 | A | 11/1984 | Wagner, Jr. et al. |
| 5,635,712 | A | 6/1997 | Scott, III et al. |
| 6,016,191 | A | 1/2000 | Ramos et al. |
| 6,140,817 | A | 10/2000 | Flaum et al. |

(Continued)

FOREIGN PATENT DOCUMENTS

| | | | | |
|---|---|---|---|---|
| EP | 2163723 | A1 * | 3/2010 | ..... E21B 33/124 |
| WO | 2007109860 | A1 | 10/2007 | |
| WO | 2016105210 | A4 | 11/2016 | |

OTHER PUBLICATIONS

Pratyush et al. "Nanologging: Use of Nanorobots for Logging," SPE-104280 (Year: 2006).*

(Continued)

*Primary Examiner* — John Fitzgerald

(74) *Attorney, Agent, or Firm* — Osha Bergman Watanabe & Burton LLP

(57) ABSTRACT

A well bore logging tool for measuring a pore fluid property of a hydrocarbon reservoir that may include, a tool housing, a vessel containing a tracer, a launcher attached to the vessel that may be configured to inject a tracer into the hydrocarbon reservoir. The well bore logging too may further include a retrieval device configured to extract at least a portion of the tracer from the hydrocarbon reservoir. The well bore logging too may further include a storage canister may be configured to store a portion of the tracer extracted from the hydrocarbon reservoir, and a scanning device may be configured to read a value of at least one fluid saturation property detected by the tracer. The vessel, launcher, retrieval device, storage canister, and scanning device may be enclosed in a tool housing.

14 Claims, 4 Drawing Sheets

An Embodiment of the Logging Tool Functional Components

(56) References Cited

U.S. PATENT DOCUMENTS

| | | | | |
|---|---|---|---|---|
| 8,881,809 | B2 * | 11/2014 | Verret | E21B 47/11 166/250.12 |
| 9,063,252 | B2 * | 6/2015 | Kamal | G01V 11/00 |
| 9,523,789 | B2 * | 12/2016 | Kamal | G01V 11/00 |
| 9,719,302 | B2 | 8/2017 | Linyaev et al. | |
| 10,408,040 | B2 * | 9/2019 | Angelescu | G01N 11/02 |
| 10,815,768 | B2 * | 10/2020 | Alaas | G06K 7/10366 |
| 11,015,430 | B2 * | 5/2021 | Angelescu | E21B 47/0224 |
| 2004/0257241 | A1 * | 12/2004 | Menger | E21B 47/12 340/854.3 |
| 2005/0055162 | A1 * | 3/2005 | Gao | G01V 11/002 702/2 |
| 2009/0166035 | A1 | 7/2009 | Almaguer | |
| 2010/0102986 | A1 * | 4/2010 | Benischek | E21B 47/125 340/855.8 |
| 2010/0242585 | A1 * | 9/2010 | Pratyush | E21B 47/01 901/1 |
| 2010/0264915 | A1 * | 10/2010 | Saldungaray | G01V 3/32 324/303 |
| 2010/0268470 | A1 * | 10/2010 | Kamal | E21B 47/13 977/953 |
| 2011/0277996 | A1 * | 11/2011 | Cullick | E21B 43/16 166/250.12 |
| 2016/0258869 | A1 * | 9/2016 | Ostafin | G01N 33/84 |
| 2018/0216453 | A1 * | 8/2018 | Angelescu | G01N 1/16 |
| 2019/0128117 | A1 * | 5/2019 | Dumont | E21B 49/10 |
| 2020/0018152 | A1 * | 1/2020 | Angelescu | G01N 1/12 |
| 2021/0047903 | A1 * | 2/2021 | Albert | E21B 43/119 |

OTHER PUBLICATIONS

Sanni et al. "Reservoir Nanorobots," The Saudi Arabia Aramco Journal of Technology, pp. 44-51 (Year: 2008).*

Kamal, "A Proposal for Debate—Nanorobot Technology for Mapping Erratic High Permeability Pathways in Carbonate Crude Oil Reservoirs," GeoFrontier, vol. 1, Issue 4, pp. 18-20 (Year: 2003).*

* cited by examiner

An Embodiment of the Logging Tool Deployed in a Well Bore

ADVANCED MATERIALS GUN AND LOGGING BOTS FOR DEEP SATURATION MEASUREMENT

BACKGROUND

In the planning, construction, and operation of an oil or gas field, it is frequently important to understand the properties of the fluid within the pores of the hydrocarbon reservoir. These properties include, without limitation, the relative proportions of oil, gas, and water, as well as the presence of contaminant such as sulpher and hydrogen sulphide. This information is used when planning the type and size of surface processing and storage facilities that are required, the optimal production rates to use, and whether secondary production methods, such as downhole pumps, and enhanced oil recovery methods, such as water injection, will be necessary.

Well bore logging tools measure physical properties of the hydrocarbon reservoir, such as density, resistivity, or nuclear magnetic resonance, which may be used to infer properties of the fluid within the pores of the hydrocarbon reservoir. However, well bore logging tools typically have depths of investigation which are at most a few feet, and usually only a few inches. By depth of investigation, we mean the radial distance from the well bore wall that delimits the portion of the hydrocarbon reservoir to which the well logging tools' measurement is sensitive.

The portion of the hydrocarbon reservoir close to the well bore is frequently not representative of the whole of the reservoir. For example, the process of drilling the well bore, installing a casing to support the well bore walls, and subsequent production of hydrocarbon fluids can all alter the hydrocarbon reservoir in the vicinity of the well bore. In particular, the fluid within the pores of the hydrocarbon reservoir can be displaced by the fluid used to lubricate and cool the drill bit, and remove rock fragments, during drilling. Also, the reduction in pressure around the well bore required to produce fluids from the hydrocarbon reservoir, to suck them from the hydrocarbon reservoir, may also cause phase changes in the fluids remaining within the pores. These changes may include the condensing of crude oil from the gas originally present in the pores.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a well bore logging tool for measuring a pore fluid property of a hydrocarbon reservoir that may include, a tool housing, a vessel containing a tracer, a launcher attached to the vessel that may be configured to inject a tracer into the hydrocarbon reservoir. The well bore logging too may further include a retrieval device configured to extract at least a portion of the tracer from the hydrocarbon reservoir. The well bore logging too may further include a storage canister may be configured to store a portion of the tracer extracted from the hydrocarbon reservoir, and a scanning device may be configured to read a value of at least one fluid saturation property detected by the tracer. The vessel, launcher, retrieval device, storage canister, and scanning device may be enclosed in a tool housing.

In general, in one aspect, embodiments relate to a method for making a measurement of a pore fluid property of a hydrocarbon reservoir. The method may include, inserting a logging tool into a well bore traversing the hydrocarbon reservoir. The logging tool injects a tracer into the hydrocarbon reservoir, and then extracts at least a portion of the tracer from the hydrocarbon reservoir. At least a portion of the tracer extracted from the hydrocarbon reservoir may be stored in a storage canister, and the value of a fluid saturation property detected by the tracer may be read by a scanning device.

Other aspects and advantages of the claimed subject matter will be apparent from the following description and the appended claims.

BRIEF DESCRIPTION OF THE DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
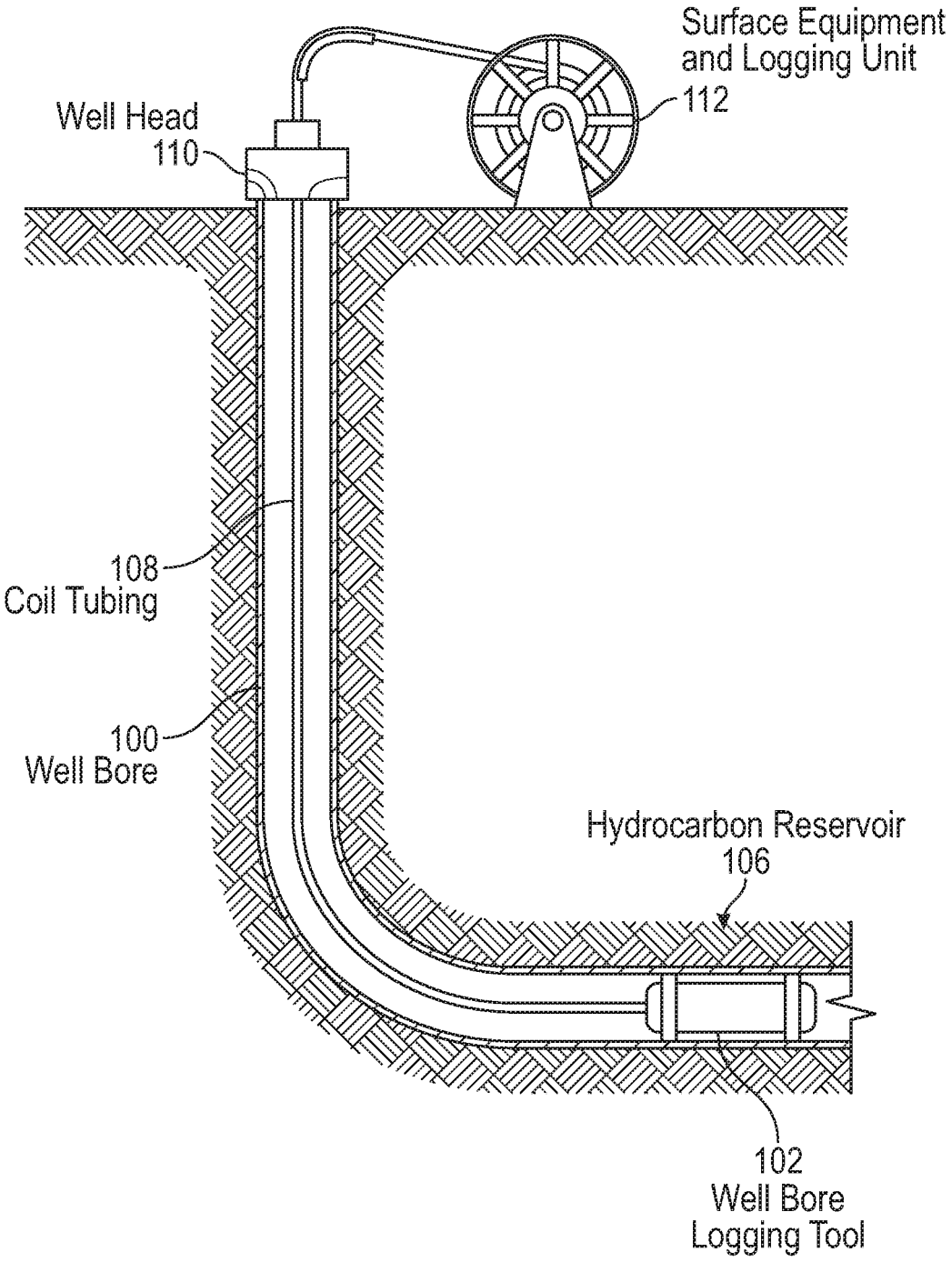
FIG. 1—An embodiment of a well bore logging tool deployed in a well bore.

FIG. 1 depicts a well bore logging tool (102), in accordance with one embodiment, deployed in a well bore (100) to measure a property of the fluid within the pores of a hydrocarbon reservoir (106). In this embodiment, the well bore logging tool (102) is attached to coiled tubing (108). The coil tubing lowers, or pushes, the well bore logging tool (102) into the well bore prior to making measurements and raises, or pulls, the well bore logging tool (102) out of the well bore (100) after making measurements. In other embodiments, the well bore logging tool (102) may be attached to a wireline, or a drill-pipe either as part of the drilling operation or after drilling.

Figure 2:
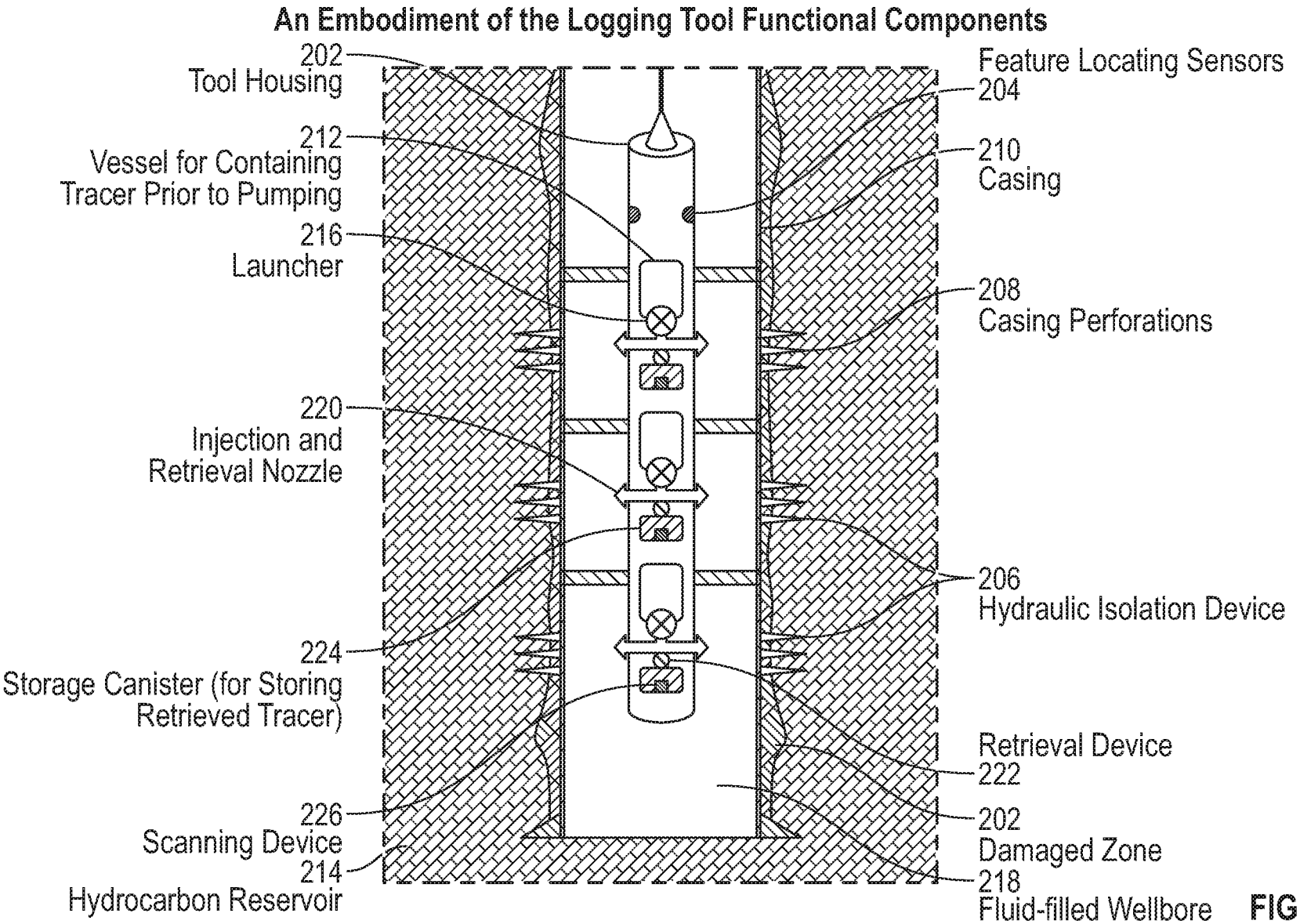
FIG. 2—A depiction of the functional components of an embodiment of a well bore logging tool.

FIG. 2 depicts an embodiment of the well bore logging tool (102). The components of the well bore logging tool (102) may comprise a tool housing (202) on which, or in which, the components are mounted. In some embodiments, the upper end of the tool housing may be attach to coiled tubing. In some embodiments, the upper end of the tool housing may be attach to wireline or drill-pipe. The well bore logging tool (102) may include one or more feature locating sensors (204). In one embodiment, the feature locating sensors (204) may comprise a laser source and camera received sensitive to laser light. In accordance with some embodiments, the feature locating sensors (204) may comprise an ultrasonic source and an ultrasonic receiver. In some embodiments, the ultrasonic source and ultrasonic receiver may be two separate ultrasonic transducers. In some embodiments, the ultrasonic source and ultrasonic receiver may be integrated into a single ultrasonic transducer. In some embodiments, the feature detecting sensors electrodes may include electromagnetic sources and receivers.

In some embodiments, the well bore feature locating sensors (204) may be configured to detect lithology features, such as rock bed boundaries or fractures in the well bore wall, in an open well bore. In some embodiments, the well bore feature locating sensors (204) may be configured to detect perforation holes (208) in a well bore lined with a casing (210).

The well bore logging tool (102) may also comprise one or more hydraulic isolation devices (206). Each hydraulic isolation device may extend from the tool housing (202) to the casing (210), wholly or partially hydraulically isolating the well bore hydraulically. When deployed, the hydraulic isolation device hydraulically isolates one or more segments of the fluid-filled well bore (202) such that well bore fluid is prevented from flowing from one side of the hydraulic isolator to the other side. That is, the hydraulic isolator prevents fluid from above the hydraulic isolator in the well bore to flow to below the hydraulic isolator in the well bore, and vice versa.

The well bore logging tool (102) may further comprise a vessel for containing tracer prior to pumping (212) of the tracer into the fluid-filled well bore (218) and from the fluid-filled well bore into the hydrocarbon reservoir (214). The vessel for containing tracer prior to pumping (212) may be attached to a launcher (216). The launcher (216) may controllably release the tracer into the fluid-filled well bore (218) through one or more injection and retrieval nozzles (220). In one embodiment, the injection and retrieval nozzles (220) may pump tracer into the fluid-filled well bore directly. In accordance with other embodiments, the injection and retrieval nozzles (220) may be pressed against the well bore wall and facilitate pumping the tracer directly into the hydrocarbon reservoir (214).

The well bore logging tool (102) may further comprise a retrieval device (222) that sucks a portion of the tracer from the hydrocarbon reservoir and stores a portion of the tracer in a storage canister (224) for storing the retrieved tracer. In some embodiments, the retrieval device may suck a portion of the tracer directly from the well bore walls. In some embodiments, the retrieval device may suck the tracer from the fluid-filled well bore (218).

In some embodiments, the retrieval device may suck the tracer inward through the same nozzle that the launcher (206) uses to pump the tracer out into the fluid-filled well bore (218) and into the hydrocarbon reservoir (214). In some embodiments, the launcher (206) may be attached to one injection nozzle (220), and the retrieval device (224) may be attached to a different retrieval nozzle (220) used exclusively to suck the tracer out from the well bore and into the well bore logging tool (102) for storage and analysis.

The well bore logging tool (102) may further comprise a scanning device (226) that may analyze a portion of the tracer while the well bore logging tool (102) is deployed downhole. In some embodiments, the result of analysis may be stored in a digital form in a computer readable medium in the well bore logging tool (102). In some embodiments, the results of analysis may be transmitted to the surface end of the well bore using wireline telemetry, or through pressure-pulse telemetry, or through other means of telemetry familiar to one of ordinary skill in the art.

In some embodiments, the well bore logging tool (102) stores a portion of the tracer in the storage canister but does not analyze the tracer until the well bore logging tool (102) has return to the surface. At the surface, the tracer may be retrieved from the well bore logging tool (102) and analyzed in a laboratory, either near the well bore's surface location and or transported to a remote location for analysis.

FIGS. 3A, 3B, 3C, and 3D may describe a method of using the well bore logging tool (302). Many variations on the pattern of use shown in FIGS. 3A, 3B, 3C, and 3D could be imagined by one of ordinary skill in the art. Thus, the sequence of steps described below are merely illustrative of one method of usage.

Figure 3A:
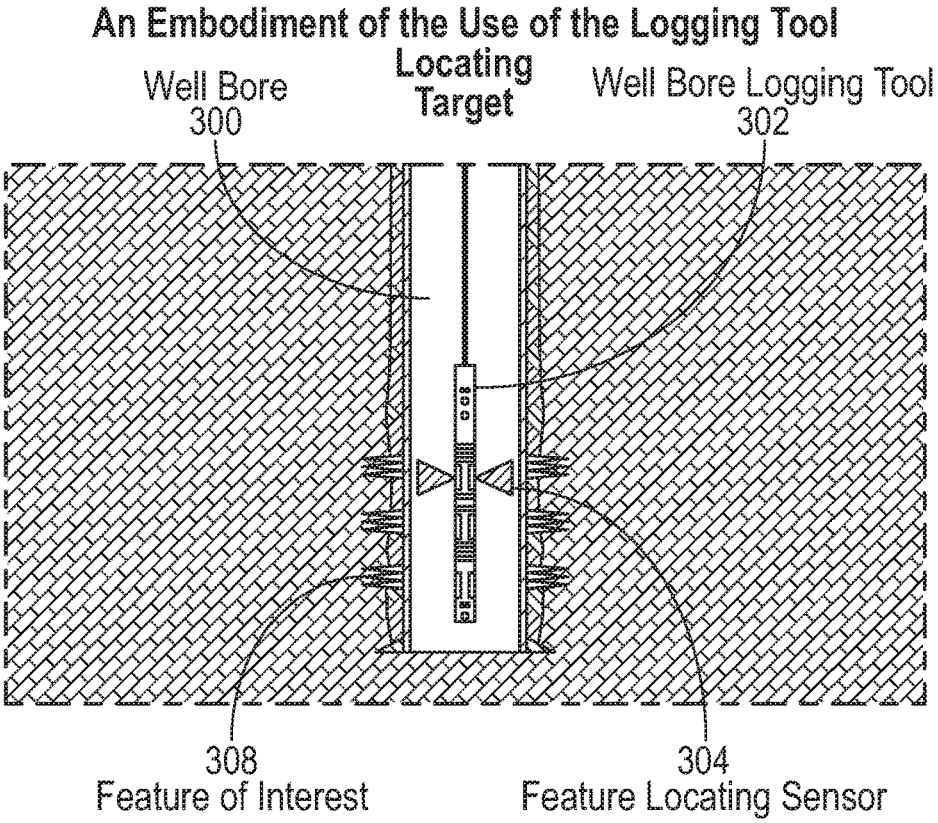
FIG. 3—A depiction of the functional steps involved in using an embodiment of a well bore logging tool.

FIG. 3A shows the lowering of the well bore logging tool (302) into the well bore (300) to the approximate depth of the feature of interest (308). In the situation shown, the feature of interest (308) is a group of perforation in a casing. However, in other situations the feature of interest (308) may be, without limitation a geological layer of interest, a naturally occurring fracture, or a hydraulic fracture.

The feature locating sensor (304) may then be used to detect the feature of interest (308) and to measure the depth of the feature of interest (308). The depth of the feature of interest (308) may then be communicated to the surface and the position of the well bore logging tool (302) may be adjusted accordingly to bring the depth of the well bore logging tool (302) into the desired relationship with the depth of the feature of interest (308).

Figure 3B:
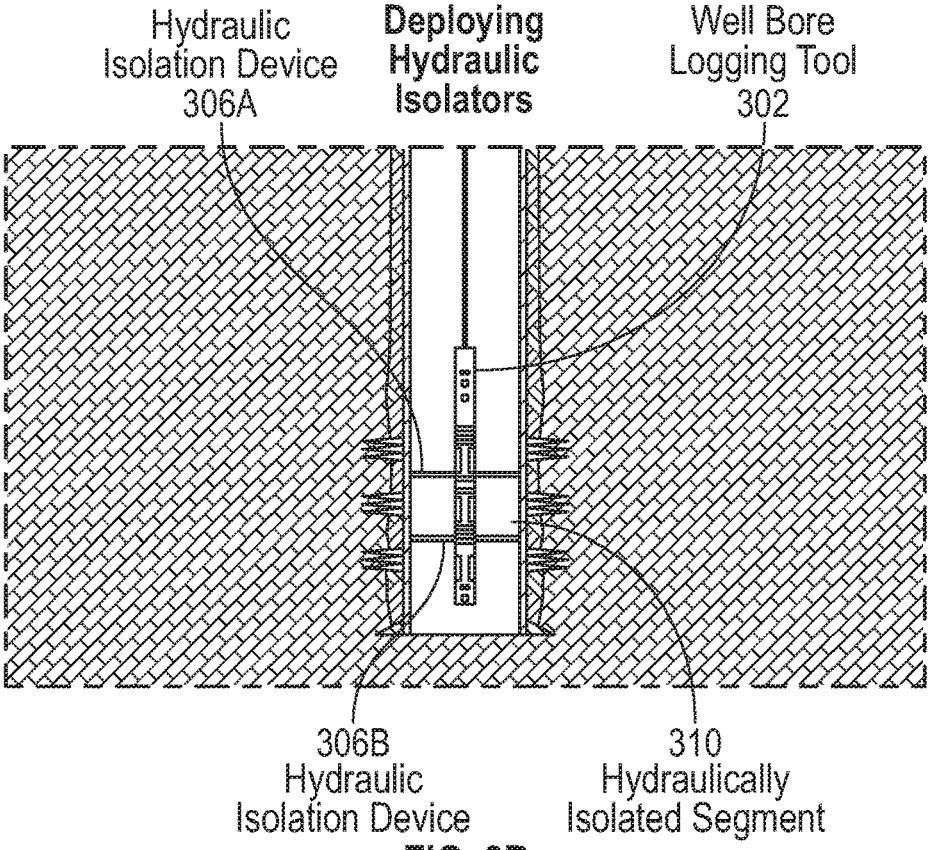

FIG. 3B shows the well bore logging tool (102) when well bore logging tool (102) has been positioned at the desired depth. After the well bore logging tool (302) has been positioned at the desired depth, the hydraulic isolation devices (306A, 306B) may be deployed to block the well bore (300) and create a hydraulically isolated segment (310) of the well bore. In some embodiments, the well bore logging tool may have a plurality of hydraulic isolation devices located at different positions along its length to create a plurality of hydraulically isolated segments (310) of the well bore (310). In other embodiments, only a single hydraulically isolated segment (310) may be created.

Figure 3C:
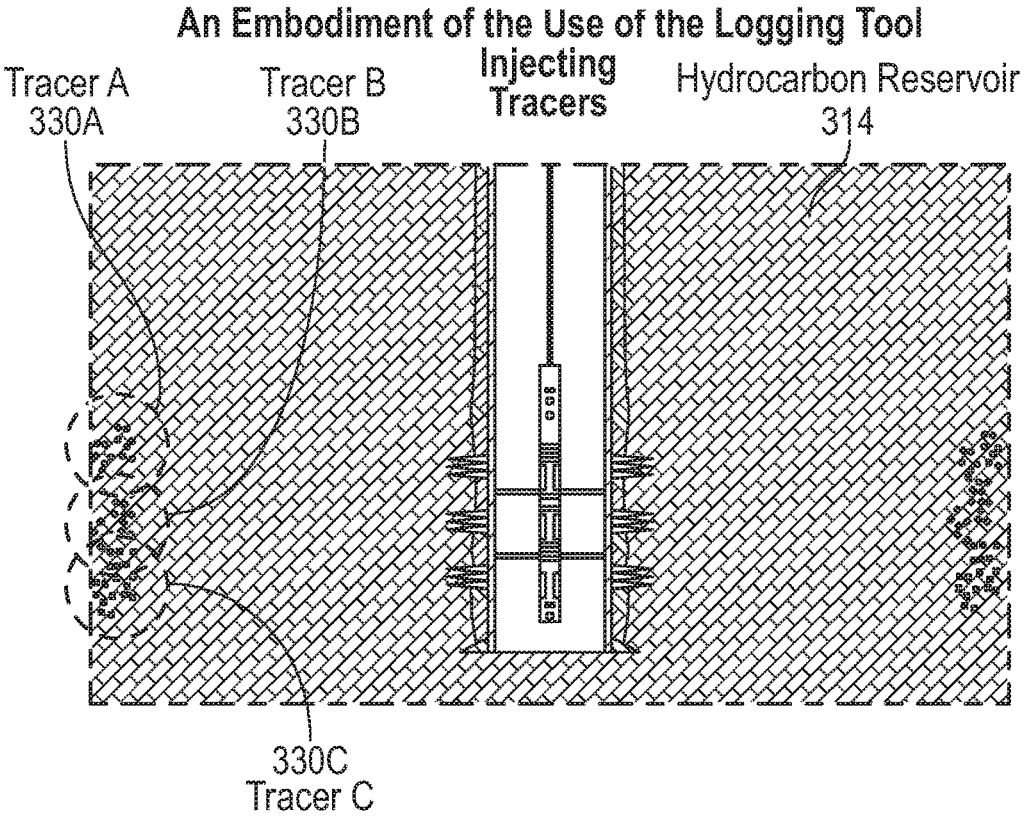

FIG. 3C shows a plurality of tracers being injected into the hydraulically isolated segments (310) of the well bore and from there into the hydrocarbon reservoir (314) surrounding the well bore (300). In some embodiments, only a single tracer may be injected into the hydraulically isolated segments (310) of the well bore and from there into the hydrocarbon reservoir (314). In some embodiments, a different type of tracer may be injected into each different hydraulically isolated segment (310) of the well bore.

Figure 3D:
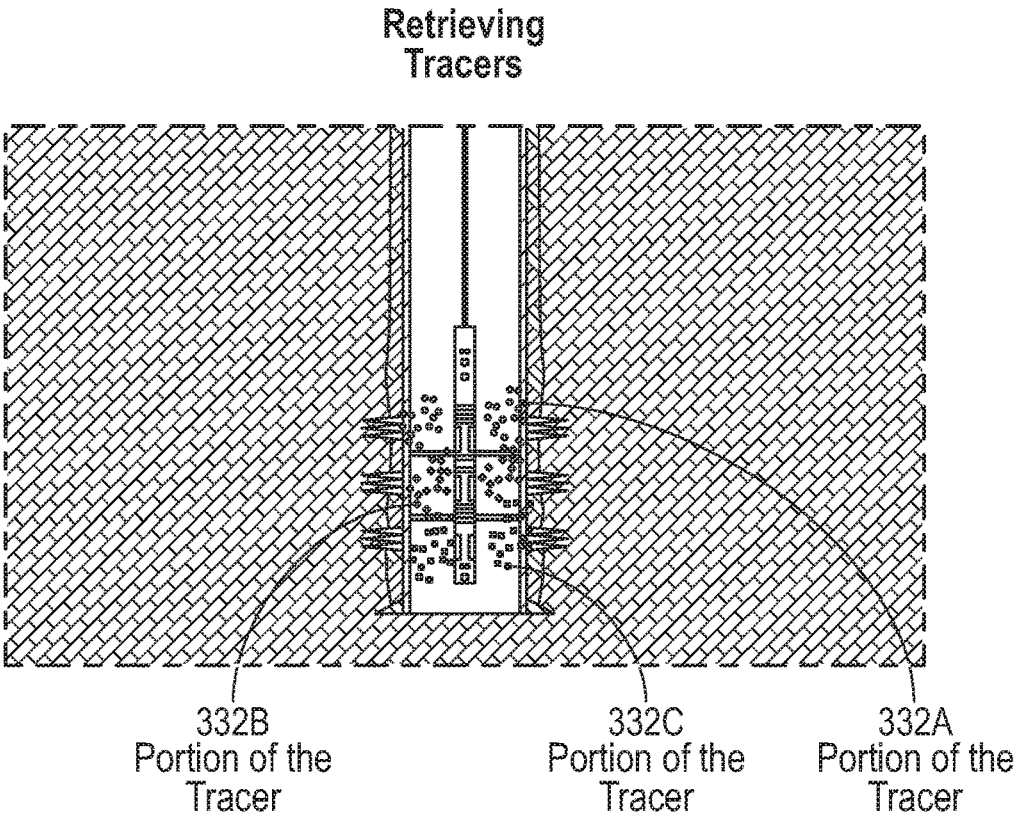

FIG. 3D shows a later time, after the time depicted in FIG. 3C, when at least some portion of the tracer (332A, 332B, 332C) may be sucked back into the well bore (300) and into the well bore logging tool (302) by the retrieval device (222). In accordance with some embodiments, a portion of the tracer (332A, 332B, 332C) may be stored in a storage canister (224) within the well bore logging tool (302) for later analysis when the well bore logging tool (302) is lifted to the surface. In some embodiments, a portion of the tracer (332A, 332B, 332C) may be analyzed by a scanning device (226), which may read a characteristic of the tracer, and may store the information in computer storage. In some embodiments, a portion of the tracer (332A, 332B, 332C) may be analyzed by a scanning device (226), which may read a characteristic of the tracer (332A, 332B, 332C), and may transmit the information to the surface via a telemetry system. In some embodiments, a portion of the tracer (332A, 332B, 332C) may be stored in the storage canister (224), and the characteristics of a portion of the tracer (332A, 332B, 332C) may be analyzed by a scanning device (226), and the information of read by the scanning device (226) may be both stored in computer memory and transmitted to the surface through a telemetry system.

At the conclusion of the deployment of the well bore logging tool (302), the hydraulic isolation devices (306A, 306B) may be retracted and the well bore logging tool (302) lifted to the surface.

In some embodiments, the tracer (332A, 332B, 332C) described in FIG. 2, FIG. 3, and the preceding paragraphs may be reactive chemicals sensitive to a property of the pore fluid. In some embodiments, the tracer described in FIG. 2, FIG. 3, and the preceding paragraphs may be nano-scale sized sensors sensitive to a property of the pore fluid. The nano-scale sized sensors may be a nano-scale sized electromechanical device. These tracers may, without limitation, be sensitive to pore volume, pore fluid saturation composition, pore fluid saturation acidity, pore fluid phase (i.e., gas or liquid), pore fluid acidity, pore fluid electrical resistance, pore fluid density, and pore fluid chemical composition.

Unless defined otherwise, all technical and scientific terms used have the same meaning as commonly understood by one of ordinary skill in the art to which these systems, apparatuses, methods, processes and compositions belong.

It is noted that one or more of the following claims utilize the term "where" or "in which" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising." For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

As used in the Specification and appended Claims, the singular forms "a", "an", and "the" include plural references unless the context clearly indicates the contrary. The verb "comprises" and its conjugated forms should be interpreted as referring to elements, components or steps in a non-exclusive manner. The referenced elements, components or steps may be present, utilized or combined with other elements, components or steps not expressly referenced.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

Ranges may be expressed as from about one particular value to about another particular value, inclusive. When such a range is expressed, it is to be understood that another embodiment is from the one particular value to the other particular value, along with all particular values and combinations thereof within the range.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A well bore logging tool for measuring a pore fluid property of a hydrocarbon reservoir, comprising:

a tool housing;

a vessel containing a tracer;

the vessel being attached to a launcher configured to inject a tracer into the hydrocarbon reservoir;

a retrieval device configured to extract at least a portion of the tracer from the hydrocarbon reservoir;

a storage canister configured to store the portion of the tracer extracted from the hydrocarbon reservoir; and a scanning device configured to read a value of at least one fluid saturation property detected by the tracer, wherein the tool housing encloses the vessel, launcher, retrieval device, storage canister, and scanning device.

2. The well bore logging tool of claim 1, wherein the storage canister is configured to store the portion of the tracer extracted from the hydrocarbon reservoir for analysis after the tool housing is removed from the well bore.

3. The well bore logging tool of claim 1, further comprising, a hydraulic isolation device that is retractably deployed to at least partially hydraulically isolate a first segment of the well bore from a second segment of the well bore.

4. The well bore logging tool of claim 1, further comprising a feature locating sensor for locating a position of a feature in the well bore.

5. The well bore logging tool of claim 4, wherein the feature in the well bore is a perforation in a casing lining the well bore.

6. The well bore logging tool of claim 4, wherein the feature in the well bore is a fracture in the hydrocarbon reservoir surrounding the well bore.

7. The well bore logging tool of claim 4,
wherein, the feature locating sensor further comprises a laser and a camera.

8. The well bore logging tool of claim 4,
wherein, the feature locating sensor further comprises an ultrasonic transducer.

9. The well bore logging tool of claim 1,
wherein the tracer is a reactive chemical sensitive to a property of the pore fluid.

10. The well bore logging tool of claim 9,
wherein the property is a chemical composition.

11. The well bore logging tool of claim 9,
wherein the property is a phase.

12. The well bore logging tool of claim 1,
wherein the tracer contains a plurality of nano-scale sized sensors sensitive to a pore fluid property of a hydrocarbon reservoir.

13. The well bore logging tool of claim 12,
wherein the property is a chemical composition of the pore fluid of a hydrocarbon reservoir.

14. The well bore logging tool of claim 12,
wherein the property is the phase of the pore fluid of a hydrocarbon reservoir.

* * * * *